United States Patent [19]

Downs

[11] 4,043,578

[45] Aug. 23, 1977

[54] PORTABLE DOOR LOCK

[76] Inventor: Edgar S. Downs, 6530 Huntley Road, Worthington, Ohio 43085

[21] Appl. No.: 699,476

[22] Filed: June 24, 1976

[51] Int. Cl.[2] ..... E05C 19/18

[52] U.S. Cl. ..... 292/290

[58] Field of Search ..... 292/296, 297, 298, 288, 292/226, 290

[56] References Cited

U.S. PATENT DOCUMENTS

| | | | |
|---|---|---|---|
| 1,089,688 | 3/1914 | Bellows | 292/296 |
| 1,977,430 | 10/1934 | Dalton | 292/296 |
| 2,461,398 | 2/1949 | Sands | 292/290 X |
| 3,563,593 | 2/1971 | Leier | 292/296 |

*Primary Examiner*—Richard E. Moore

[57] ABSTRACT

A door lock which can be slipped from the inside between the edge of a door and the jamb into the latch plate carried thereby and adjusted to engage the door and prevent inward swinging. It is made as a single assembly consisting of a narrow carrier strip which has a lug on its outer end for engaging the latch-receiving opening and a carriage slidable thereon which carries a pivoted locking lever having an outer end for engaging the inner face of the door and an inner end which has a restraining portion that is biased into engagement with the adjacent face of the carrier strip and which will engage the strip more firmly when inward pressure is exerted on the door. The carriage also carries a releasing lever for engaging the locking lever to swing it in a reverse direction to release the restrainer portion from the strip and permit inward sliding movement of the carriage to disengage the outer end of the locking lever from the inner face of the door.

9 Claims, 11 Drawing Figures

PORTABLE DOOR LOCK

BACKGROUND OF THE INVENTION

Many different types of portable locks have been provided in the past which are designed to be fitted between the edge of the door and the jamb into engagement with the latch plate carried by the jamb and having means for engaging the inner face of the door to prevent inward swinging thereof. These locks have usually been of complicated expensive ratchet construction, which are difficult to apply and release, or have consisted of separate pieces which must be interfitted or assembled at the time of application to the door which requires skill and patience. Also there is always the possibility of one or more parts being lost or misplaced after removal from the door.

BRIEF DESCRIPTION OF THE INVENTION

The lock of this invention is a single assembly consisting of a carrier or guide strip, a carriage suitably mounted on the guide strip, and two levers carried by the carriage in cooperative relationship which are a locking lever and a releasing lever. The carrier strip is a flat thin narrow strip which is designed to slip between the edge of the door and the jamb and which has a laterally projecting locking lug on its outer end adapted to be slipped into the latch-receiving socket of the latch plate. On the carrier strip is slidably mounted a carriage and pivoted to that carriage are the two levers mentioned above. The locking lever preferably has a compressible pad on its outer end for engaging the face of the door and a restrainer shoulder on its inner end which normally engages the face of the carrier strip by being biased through a slot in the carriage by means of a spring associated with the locking lever pivot. The locking lever is so arranged that inward pressure on the door increases the force of engagement of the shoulder with the strip. The releasing lever is also pivoted to the carrier and has one end in engagement with the locking lever so that pressure on its other end will result in pivoting the locking lever to overcome the biasing force and release the restrainer shoulder from the carrier strip to permit inward sliding of the locking lever and disengagement of its pad from the inner face of the door. Then the door can be swung inwardly and the lock assembly can be removed.

BRIEF DESCRIPTION OF THE DRAWINGS

The best mode contemplated in carrying out this invention is illustrated in the accompanying drawings in which.

DETAILED DESCRIPTION OF THE INVENTION

With specific reference to the drawings, the lock of this invention is illustrated as comprising mainly a carrier and guide strip 21, a carriage 22 slidably mounted for longitudinal movement on the strip, and a pair of cooperating levers 23 and 24 pivotally mounted on the carriage.

Figure 10:
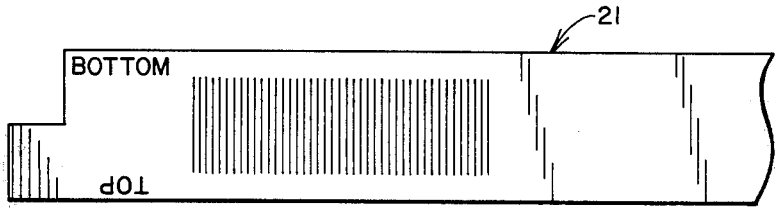
FIG. 10 is a face view of the strip.

The strip 21 is an elongated flat strip, preferably of metal, which has a latch plate engaging lug 25 at one end. The lug 25 is bent from the plane of the strip at that end laterally at a right angle, halfway intermediate its width, so that it is horizontal if the strip is on edge. At its opposite end, the strip has its edge bent to form a stop lip 26. The lug 25 and lip 26 will prevent movement of the carriage 22 off the strip, after it is slipped thereon from either end before the lug or lip is formed. As shown in FIG. 10, the strip at the lug 25 preferably has the designation "BOTTOM" and "TOP" and also preferably has a scored, knurled, or otherwise roughened, face indicated by the lines at 27.

The carriage 22 is designed to slip onto the strip 21 and to be readily slidable thereon. It is preferably formed of a plate of metal shaped to provide guides 30 on its opposed outer edges which receive the opposed side edges of the strip. Thus, the carriage 22 embraces the strip for longitudinal sliding movement but is prevented from moving off the strip by the lug 25 and lip 26.

The locking lever 23 is in the form of a plate having edges bent outwardly for strength and to form a flat outer end as indicated at 31. The end 31 carries a door-engaging pad 32 of compressible material such as plastic, rubber, felt, etc. The lever is pivoted to the carriage 22 by means of a transverse pivot or hinge 33. This hinge includes a barrel portion 34 fixed to the lever at its flat side which has a projecting transverse restrainer portion in the form of a knife edge 35. This knife edge 35 is in alignment with a transverse slot 36 formed in the adjacent carriage plate. It will be noted that this member 25 is on the shorter arm of the lever and the pad 32 is on the longer arm of the lever. A stop 37 is provided on the longer arm of the lever to limit its swinging movement by engaging with the carriage 22. The hinge 33 has a torsion spring 38 incorporated in it so as to bias the knife edge 35 through the slot 36 into contact with the strip surface 27.

The releasing lever 24 is preferably formed of a plate of metal which is pivoted intermediate its ends to the carriage 22 by a transverse hinge structure 40 located on the side of the slot 36 opposite to the hinge 33. The lever 24 is so located that its shorter end is disposed beneath the shorter end of the locking lever 23. The two levers will normally be biased into the positions indicated in FIG. 3. However, finger pressure on the outer end of the releasing lever 24 will swing its shorter end away from the carriage, overcoming the resistance of the spring 38. This will move the restraining knife edge shoulder 35 out of the slot 36 away from the strip surface 27. A finger pad 39 of plastic or the like may be provided on the lever 24 as indicated.

Figure 1:
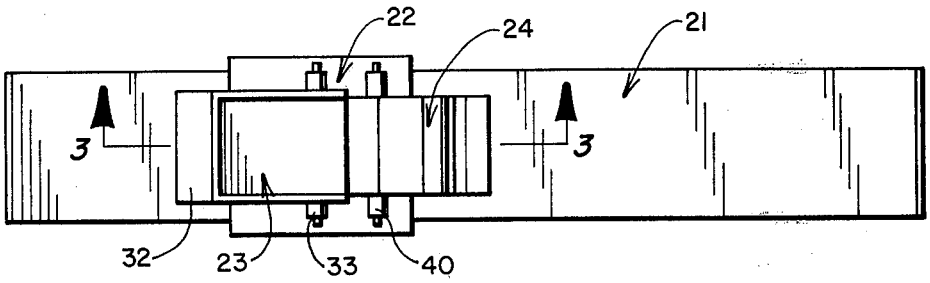
FIG. 1 is an elevational view showing one face of the lock.
Figure 2:
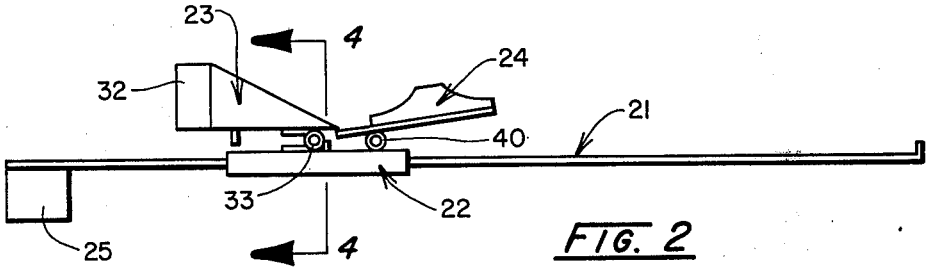
FIG. 2 is an edge view of the lock.
Figure 3:
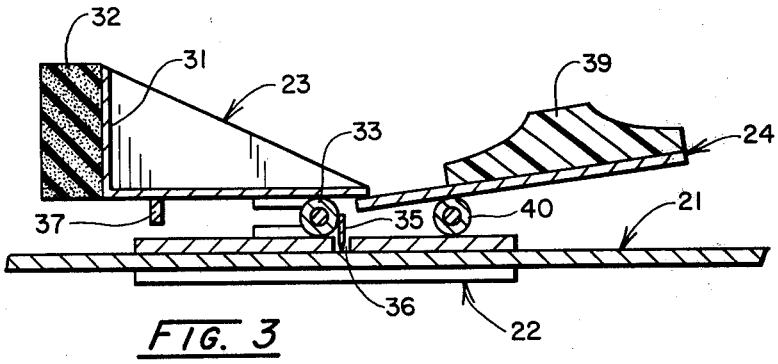
FIG. 3 is a longitudinal sectional view taken along line 3—3 of FIG. 1.
Figure 4:
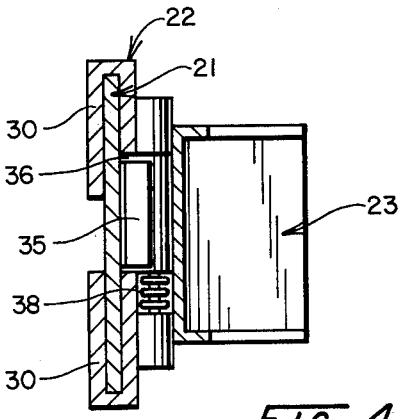
FIG. 4 is a sectional view taken along line 4—4 of FIG. 2.
Figure 5:
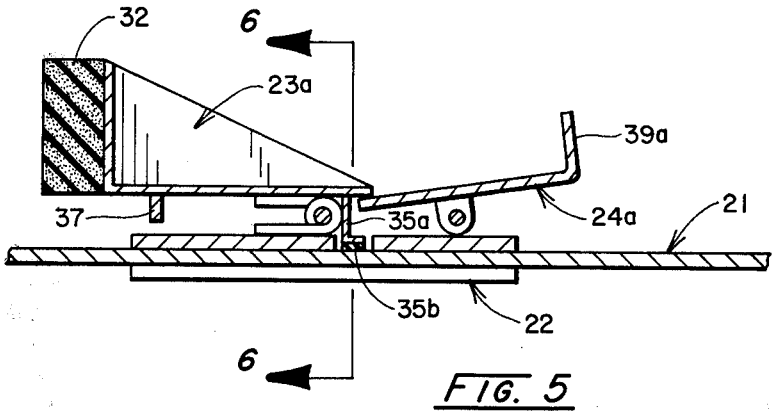
FIG. 5 is a view similar to FIG. 3 but showing a modification of the lock.
Figure 6:
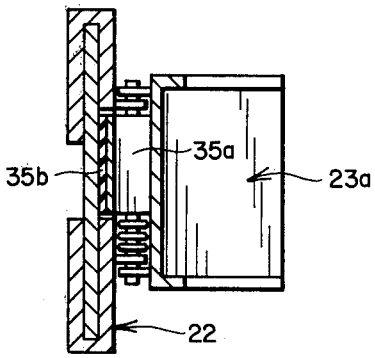
FIG. 6 is a sectional view taken on line 6—6 of FIG. 5.

The modification of the lock assembly in FIGS. 5 and 6 is of the same basic structure as that of FIG. 3 and 4 but the lever **24*a* is not provided with the finger pad 39. Instead it merely has its free end 39*a* turned at a right angle to its plane to provide a lug which can be engaged by the finger to press the lever 24a downwardly. Also, instead of the restraining shoulder being in the form of the knife edge 35, it is in the form of a flat shoulder 35b formed of rubber, felt or abrasive material which will contact the strip surface 27 and will not slide or skid therealong. It is carried by an L-shaped lug of metal 35a carried by the lever 23a in the same manner as member 35**.

Figure 7:
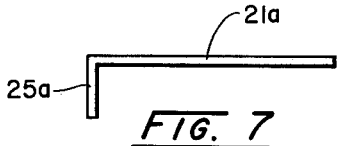
FIG. 7 is a view showing a modified latch plate engaging lug.
Figure 8:
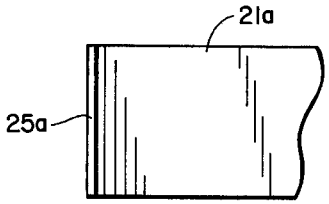
FIG. 8 is another view of the lug.
Figure 9:
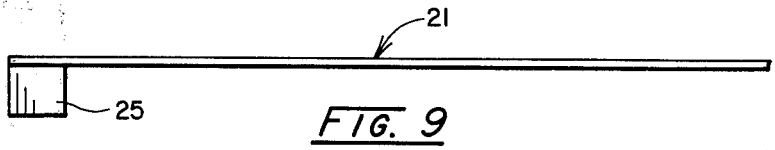
FIG. 9 is an edge view of the carrier strip.

In FIGS. 7 and 8, the latch plate engaging portion of the strip 21a is of a different formation. In this instance, the end of the strip is bent at a right angle to provide the lug 25a extending the full transverse width of the strip.

Figure 11:
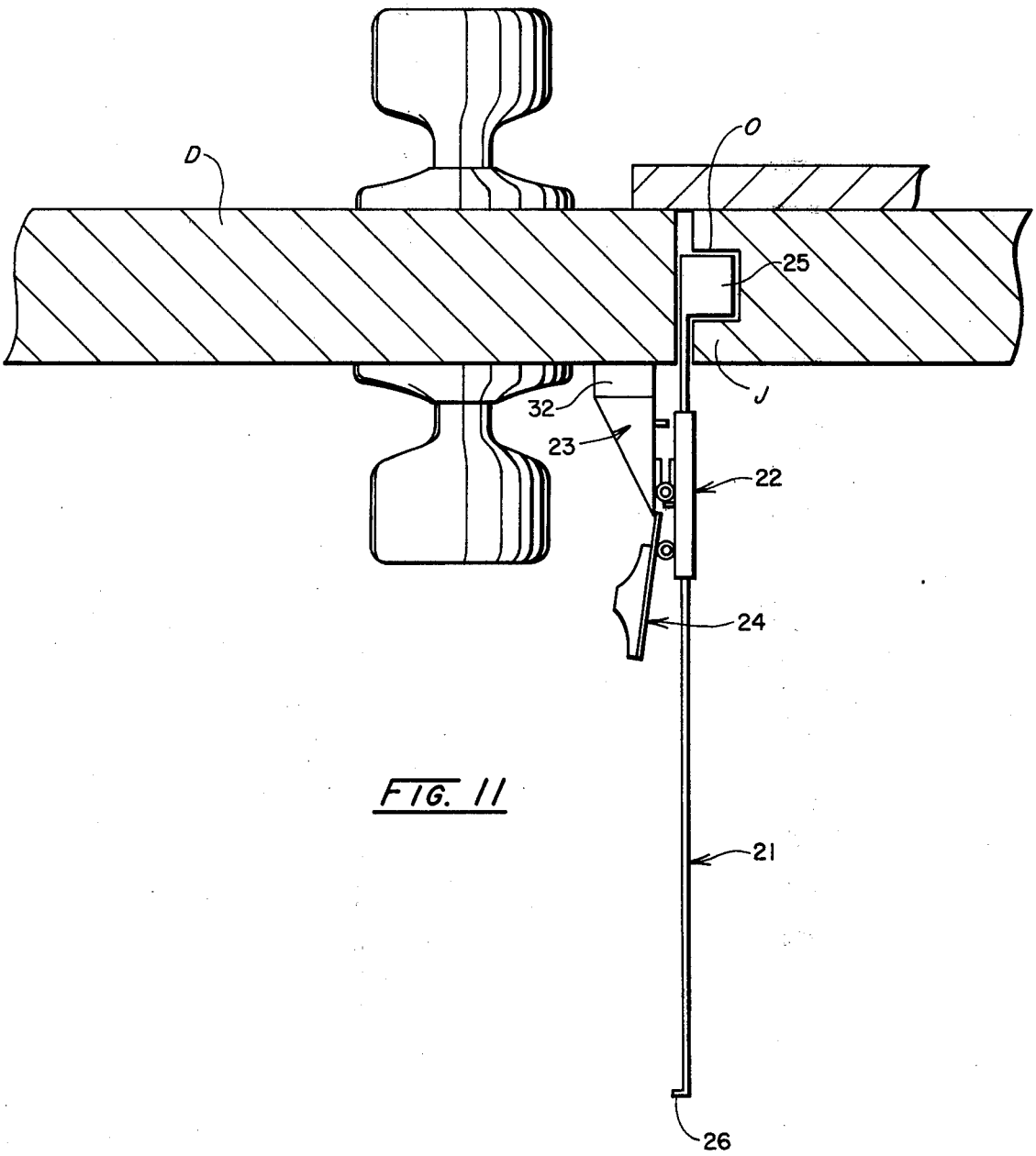
FIG. 11 shows the lock in cooperative locking position with the door.

The lock can be easily carried and in use is applied to the door D as indicated in FIG. 11. The strip 21 is slipped between the door jamb J and the edge of the door as the door is swinging into closed position until the lug 25 can be positioned in the latch-receiving opening O, it being understood that the carriage 22 will be moved inwardly on the strip 21 to a non-interfering position. The designations "BOTTOM" and "TOP" on the strip will indicate the position of the lug 25 in the opening O relative to the latch bolt, depending on which side the door is hinged. The carriage 22 will be slipped forwardly or outwardly on the strip 21, by applying pressure to the releasing lever 24, until the pad 32 will be pressed against the face of the closed door D. Removing finger pressure from the lever 24 will permit the biasing spring 38 to swing the knife edge restraining shoulder 35 into contact with the strip surface 27 and thereby restrain rearward or inward movement of the locking lever 23. Thereafter, any inward pressure on the door D will tend to swing the locking lever 23 about its hinge 33 so as to move the shoulder 35 more firmly in contact with the strip surface 27. Thus, the door D will be firmly locked in place. To remove the lock, it is merely necessary to press on the releasing lever 24 so as to swing the locking lever 23 slightly in a reverse direction by compressing the pad 32 slightly against the face of the door. This releases the restraining shoulder 35 from the strip surface 27 and will permit inward sliding of the carriage 22 along with the locking lever 23. Thereafter, the door D can be swung inwardly and the lock removed.

If the strip 21a is used, the "TOP" and "BOTTOM" designations need not be used because of the formation of the lug 25a. Lug 25 is preferred because it is stronger and usually there is sufficient space in the latch socket to permit the latch bolt to enter the socket with the lug above or below it.

If the structure of FIG. 5 is used, the function will be the same except that the shoulder 35b will provide a non-skid engagement with the strip surface 27, which need not necessarily be roughened whether this restraining shoulder or the shoulder 35 is used although the roughened surface is desirable.

It will be apparent that the lock described can be made as a single, inexpensive, single assembly. It can be easily carried and can be applied easily without skill to the door or be readily removed therefrom. The parts are always assembled and simple adjustments only are necessary in applying or removing the lock.

Having thus described this invention what is claimed is:

1. A portable lock in the form of a single assembly comprising an elongated relatively thin guide strip adapted to be inserted between the edge of a door and its cooperating jamb and having a latch-engaging lug adjacent the forward end thereof for engaging a latch portion on the jamb when so inserted, a carriage slidably mounted on the strip for movement longitudinally thereof relative to said lug, a locking lever and a releasing lever pivotally mounted on the carriage in cooperative relationship, said locking lever being pivoted intermediate its ends about a pivot transversely of the carriage and the guide strip to provide a forward and rearward lever arm, a transversely disposed door-face-engaging portion on the forward end of the locking lever ahead of said transverse pivot and parallel thereto in the form of a yieldable pad, a transversely disposed restraining shoulder on the rear end of the locking lever behind said transverse pivot and parallel thereto on a member passing through the carriage into engagement with the adjacent face of the strip, a spring cooperating with said locking lever for normally biasing it about said transverse pivot to cause said shoulder to engage said strip face, said pad engaging the door face to yield to a limited extent when the strip is inserted in locking position between the door and jamb and the carriage is moved forward on the strip as far as possible, any opening pressure against the door tending to swing the locking lever about its pivot to increase the engagement of the shoulder with the strip face, said releasing lever being pivoted intermediate its ends about a pivot transversely of the carriage and the guide strip to provide a forward and rearward lever arm, said pivot being located behind and parallel to the pivot for the locking lever, the forward end of the releasing lever being positioned beneath the rear end of the locking lever so that pressure on the rear end of the releasing lever will pivot the locking lever forwardly to cause the pad to yield sufficiently to disengage the releasing shoulder from said strip face thereby permitting rearward sliding movement of the carriage and movement of the pad away from the door face.

2. A lock according to claim 1 in which the pad is compressible and each of the levers is pivoted to the carriage by a transverse hinge, said restraining shoulder passing through a slot in the carriage between the two hinges, said spring cooperating with the locking lever being a torsion spring mounted at the hinge thereof, said locking lever hinge being located to provide a longer arm carrying the door-face-engaging portion and a shorter arm carrying the restraining shoulder, said releasing lever hinge being located to provide a shorter arm which extends under the shorter arm of the locking lever and a larger arm to receive finger pressure.

3. A lock according to claim 2 in which the strip has a roughened surface that is engaged by the restraining shoulder.

4. A lock according to claim 2 in which the restraining shoulder is in the form of a knife edge.

5. A lock according to claim 2 in which the restraining shoulder has a non-skid surface engaging the strip face.

6. A lock according to claim 2 in which the latch-engaging lug on the strip is on its one end intermediate its side edges and at a right angle to the plane thereof.

7. A lock according to claim 2 in which the latch-engaging lug on the strip is formed on its one end at a right angle to the plane thereof and extending the full width thereof.

8. A lock according to claim 2 including a stop depending from the longer arm of the locking lever for engaging the face of the strip.

9. A lock according to claim 2 including a stop on the strip adjacent the end opposite the end which carries the latch-engaging lug for engaging and stopping the slidable carriage.

* * * * *